US007392609B1

(12) United States Patent
Miska

(10) Patent No.: US 7,392,609 B1
(45) Date of Patent: Jul. 1, 2008

(54) PRESENTATION APPARATUS FOR ARTWORK

(76) Inventor: Ian Miska, 381 Checker Dr., Buffalo Grove, IL (US) 60089

( * ) Notice: Subject to any disclaimer, the term of this patent is extended or adjusted under 35 U.S.C. 154(b) by 383 days.

(21) Appl. No.: 10/820,836

(22) Filed: Apr. 8, 2004

Related U.S. Application Data

(63) Continuation of application No. 10/244,654, filed on Sep. 16, 2002, now Pat. No. 6,718,676, which is a continuation-in-part of application No. 09/327,154, filed on Jun. 7, 1999, now Pat. No. 6,449,891.

(51) Int. Cl.
*A47G 1/14* (2006.01)

(52) U.S. Cl. ..... 40/124.07; 40/789

(58) Field of Classification Search ..... 40/738, 40/774, 789, 788, 539, 743, 124.07, 124.12, 40/124.19, 538; 229/92.8
See application file for complete search history.

(56) References Cited

U.S. PATENT DOCUMENTS 956,916 A * 5/1910 Wiederseim, Jr. ..... 40/124.06
2,472,114 A * 6/1949 Marder ..... 434/404
4,237,633 A * 12/1980 Murrell ..... 40/773
4,681,253 A * 7/1987 Engelhardt ..... 229/92.8
5,035,929 A * 7/1991 Myers et al. ..... 428/30
5,494,445 A * 2/1996 Sekiguchi et al. ..... 434/365
6,173,515 B1 * 1/2001 Walsh ..... 40/124.08

FOREIGN PATENT DOCUMENTS

DE 019936414 * 10/2000

* cited by examiner

*Primary Examiner*—Cassandra Davis
(74) *Attorney, Agent, or Firm*—Vedder Price P.C.; W. Dennis Drehioff

(57) ABSTRACT

A presentation apparatus for artwork comprising a one-piece, die-cut folder construction of cardboard or other suitable material. The apparatus comprises a back section containing artwork and one or more side panels which suitable fold over the back section. The one or more side panels contain die-cut windows covered with acetate sheets or cels for viewing the artwork on the back section and may also contain artwork or images providing a three-dimensional effect for the images or artwork.

2 Claims, 7 Drawing Sheets

Fig. 10
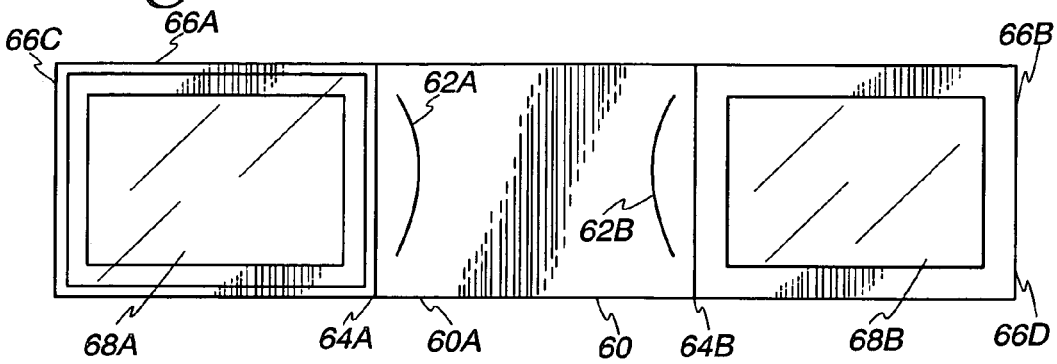
Fig. 11
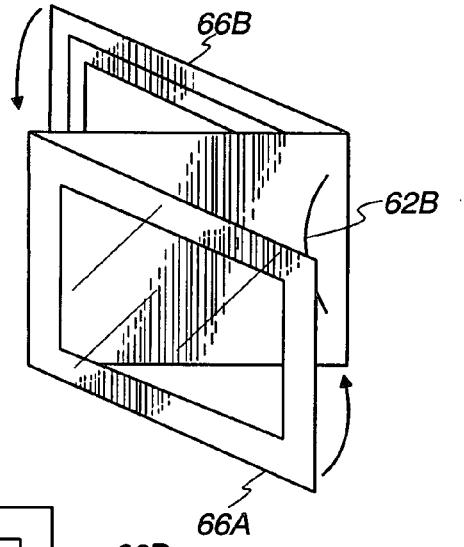
Fig. 12
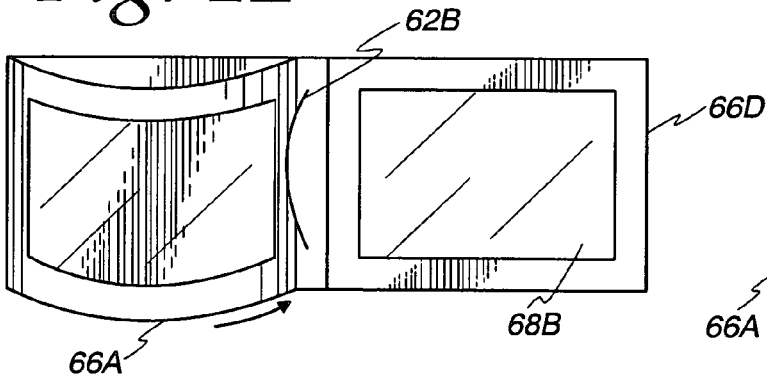
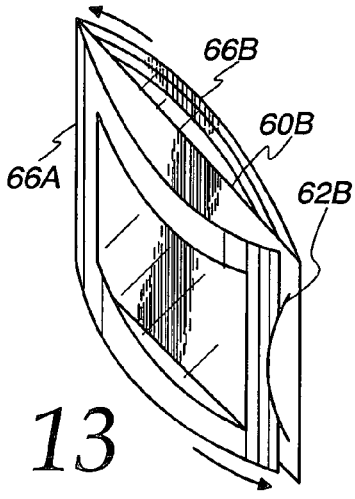
Fig. 13

PRESENTATION APPARATUS FOR ARTWORK

This application is a continuation application of U.S. Ser. No. 10/244,654 filed Sep. 16, 2002 which is a continuation-in-part application of U.S. Ser. No. 09/327,154, filed Jun. 7, 1999, now U.S. Pat. No. 6,449,891.

The present invention relates to a presentation apparatus for artwork and, more specifically, a presentation apparatus for three-dimensional artwork including greeting cards.

BACKGROUND OF THE INVENTION

Artwork can be displayed in many different ways and many different styles. One type of known artwork display is for three-dimensional artwork. This type of artwork is typically presented by providing multiple layers of transparencies, each containing a distinct image. When the images are combined, they produce a multi-layered, three-dimensional display. However, three-dimensional artwork has the disadvantage of being expensive to present in that such artwork-typically requires a special frame that can be extremely time consuming to assemble due to intricate telescoping members, etc.

U.S. Pat. No. 5,367,801 issued to Ahn discloses a multi-layered, three-dimensional display comprising three image layers which are spaced apart inside a rigid frame construction.

U.S. Pat. No. 4,438,579 issued to Engel discloses a three-dimensional picture with interchangeable scenes comprising three overlapping and telescoping images which are frictionally held with a rigid frame. The frame is provided with a dust cover.

U.S. Pat. No. 3,787,992 issued to Leonhardt discloses a dimensional picture frame comprising a box-like frame structure telescopingly surrounding a picture-mounting means to produce a multi-dimensional picture having a depth dimension thereto.

U.S. Pat. No. 3,014,302 issued to Hughes discloses an abstract art device comprising a plurality of transparent members each containing an image and being nested in a frame having a stepped inner wall, each step receiving the subsequent transparent sheet.

U.S. Pat. No. 2,565,553 issued to Foley discloses a three-dimensional picture frame comprising a plurality of concave picture sheets displayed in a box-like housing, one behind another.

U.S. Pat. No. 3,314,180 issued to Porter discloses a three-dimensional picture assembly comprising a rigid frame in which a plurality of opaque sheets are sequentially arranged and having spacers therebetween. Each opaque sheet contains partial images which combine to form a three-dimensional image.

Such examples of prior art three-dimensional display apparatus have the disadvantage that they are not only costly due to rigid and intricate frames, but also time consuming to assemble due to various telescoping members and intricate designs.

U.S. Pat. No. 4,033,060 issued to Lawrence discloses a picture frame construction comprising a picture being sandwiched between a front frame and a back frame which includes elements for spacing the frame from a wall. A backing element is used in cooperation with the back frame. The picture frame construction, once assembled, can then be hung on a wall or inserted into a box-like housing structure. The Lawrence patent is time-consuming to assemble and only discloses use for a single picture image.

U.S. Pat. No. 2,991,578 issued to Messina discloses a combination collapsible box and display device. The display device comprises a compact, foldable box comprising two basic sections. The first section is the picture-holding and display area section and the second section is the support and locking section. The first section includes a picture-holding area wherein the picture's corners are inserted into cut-out tab sections and the top edge of the picture is inserted under a tab to hold the picture in place. The picture-holding section is then folded on top of a frame section to comprise the first section. The second section includes a plurality of panels which form a box-like structure having an inside slot and an outside cut-out tab. The first section includes a locking tab which can be folded around and inserted into the outside cut-out tab of the second section to secure the display device in a compact, box-like display device. The locking tab can also be inserted into the inside slot of the second section to form an easel-like display. The Messina product is time-consuming to assemble and position and further does not make arrangements to display a three-dimensional artwork.

Accordingly, there is a need for a relatively simple and low-cost, three-dimensional presentation apparatus. The present invention fulfills such a need.

BRIEF SUMMARY OF THE INVENTION

The present invention comprises a one-piece folder construction with one or more side panels which fold over a back section which may contain an image. The one or more side panels create image screens when folded against the back section and serve as the final image screen of the presentation apparatus. The one or more side panels include die-cut window elements to present images thereon and to allow viewing of the back section of the presentation apparatus.

In use, one or more side panels are folded over the back section. The side panel(s) and die-cut elements are folded away from and secured to the back section to form the presentation apparatus. In this manner, the apparatus can be quickly and easily assembled to produce a low-cost presentation apparatus which can be mass produced.

Accordingly, it is the principal object of the present invention to provide a presentation apparatus for artwork.

It is further an object of the invention to provide a method of forming a presentation apparatus for artwork.

It is also an object of the invention to provide a low-cost presentation apparatus for three-dimensional artwork.

It is an object of the invention to provide a low-cost, three-dimensional greeting card.

It is an additional object of the present invention to provide a presentation apparatus which can be relatively easily assembled and mass produced.

BRIEF DESCRIPTION OF THE DRAWINGS

FIG. 10 is a front view of an alternate embodiment of the present invention wherein the first and second side panels, when folded, engage the back section;

FIG. 11 is a perspective view of an alternate embodiment of the present invention wherein the first and second side panels are folded to engage the front and rear of the back section;

FIG. 12 is a perspective view of an alternate embodiment of the present invention wherein one side panel is engaged in the back section;

FIG. 13 is a perspective view of an embodiment of the present invention wherein the first and second side panels are folded on opposite sides of the back section;

FIG. 24 is a front perspective view of an embodiment of the present invention showing first and second side panels folded on opposite sides of the back section with the first side panel having multiple inserts that may be configured as trading cards, coupons or the like.

DETAILED DESCRIPTION OF THE INVENTION

Figure 1:
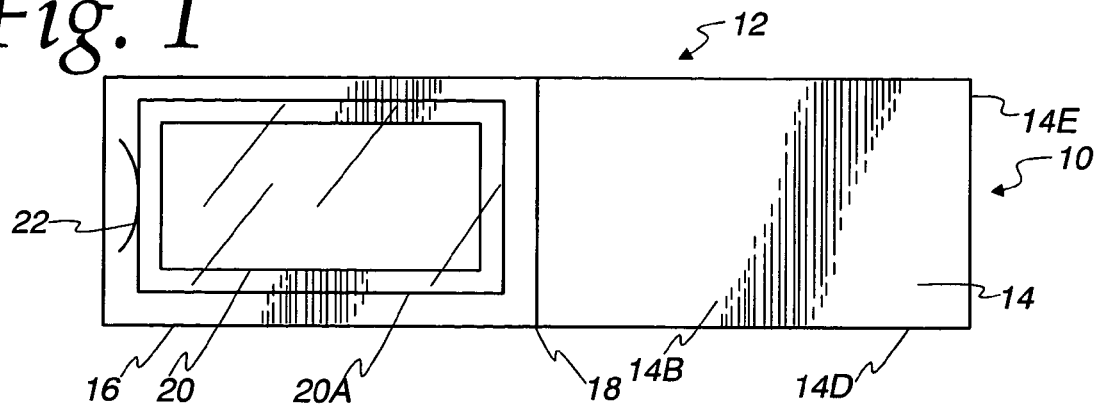
FIG. 1 is a front view of an embodiment of the present invention showing a one-piece folder configuration with a back section and a first side panel in an unfolded position.

While the invention is susceptible of embodiment in many different forms, there is shown in the drawings and will be described herein in detail a preferred embodiment of the invention. It should be understood, however, that the present disclosure is to be considered an exemplification of the principles of the invention and is not intended to limit the scope and spirit of the invention and/or claims of the embodiment illustrated.

Figure 3:
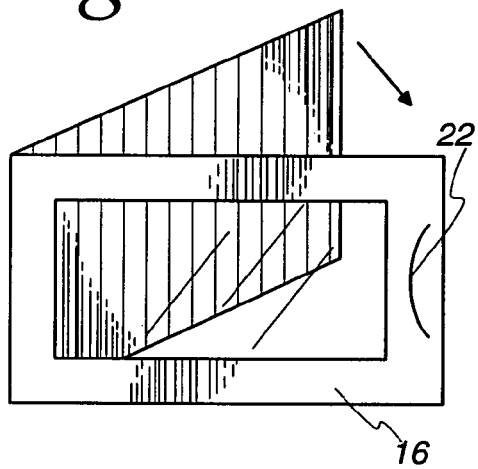
FIG. 3 is a perspective view of an embodiment of the present invention showing a side panel folded on a fold line from the back section having a lenticular image thereon.

Attention is directed to FIG. 1 for an overview of one embodiment of this invention. FIG. 1 illustrates a three-dimensional presentation apparatus 10 comprising a one-piece folder construction 12 comprising a back section 14 and a first side panel 16. The apparatus may be made of cardboard or other suitable material. The back section and side panel are separated by fold line 18. As can be seen, a die-cut window 20 is placed in the side panel for viewing the back section or image on the back section. The image may be artwork of any type, including lithography and lenticular images as shown in FIG. 3. Lenticular images provide thousands of small lenses which are joined by thousands of additional image frames using specific printing methods. The lenticular images come to life as three-dimensional, multi-action pieces. The lenticular lenses direct different images under individual cylindrical lens to the eye. In three-dimensional images, the left and right eyes see dissimilar viewpoints of the same object through a vertical parallel lens. When the lenticular image is in a horizontal position, the image is moved top to bottom so the eye perceives different images based on the angle of the lens through which the image is being viewed. The viewing angle changes as the image is moved from top to bottom, producing a multi-image, or animation, effect.

In addition, the window or cel 20 may be an image screen and contain artwork. Preferably, the window or cel 20 or image screen is made of clear acetate and has printed thereon colored litho, such as a four-color litho, to produce the image. However, it should be understood that any suitable clear material, preferably plastic or acetate, material be used for window or cel 20 or image screen and image as is known in the prior art.

Figure 2:
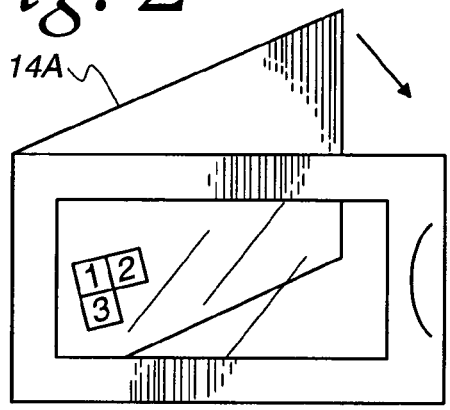
FIG. 2 is a perspective view of an embodiment of the present invention showing a side panel folded on a fold line from the back section.

Back section 14 has a rearward side 14*a* and a forward side 14*b*. The back section also contains top edge 14*c*, bottom edge 14*d*, and side edge 14*e*. Images and artwork as described are preferably presented on forward side 14*b* for viewing. As an alternative embodiment, the artwork on the forward side 14*a* of the back section may be painted by the purchaser of the presentation apparatus. The painting may be accomplished free-hand or by following numbers on a configuration provided on the back section, as shown in FIG. 2.

Side panel 14 has a slot 22 at one end for receiving the opposed end or side edge 14*e* of back section 14. Back section 14 may be flexible or rigid, allowing it to be folded into slot 22. Likewise, side panel 16 may be flexible or rigid, allowing slot 22 to engage side edge 14*e*. The flexing of back section 14 or side panel 16, when folded, provides for a sufficient amount of spacing between the two to promote a three-dimensional effect. The curvilinear shape or design of the flexed, folded back section or side panel also promotes the three-dimensional effect of the presentation apparatus.

Figure 4:
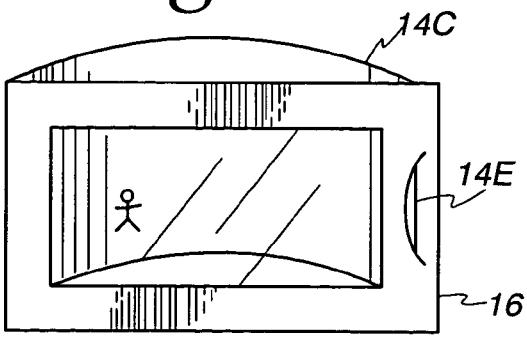
FIG. 4 is a front perspective view of the outside folder construction of an embodiment of the invention showing the folded side panel engaging the back section, the side panel having a window for viewing the back section.
Figure 5:
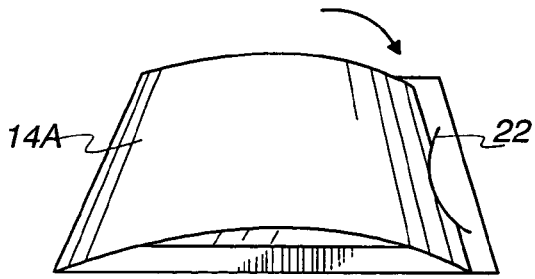
FIG. 5 is a side perspective view of an embodiment of the present invention showing the side panel engaged in the back section.

FIGS. 4 and 5 show the flexible back section being folded at fold line 18 with side edge 14*e* inserted in slot 22. The curvilinear fold of the back section allows for adequate spacing entrance of the three-dimensional effects of images (not shown) on the side panel and back section.

Figure 6:
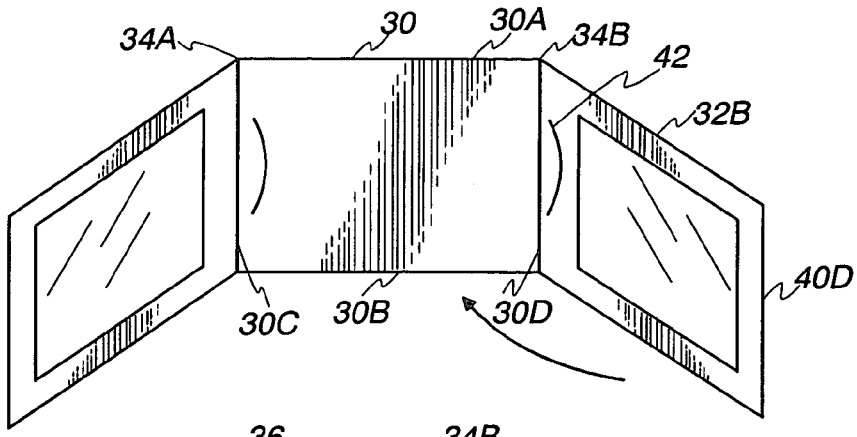
FIG. 6 is a front perspective view of an alternate embodiment of the present invention with a back section and first and second side panels wherein a first side panel engages the back section when folded and a second side panel engages the first side panel.

Illustrated in FIG. 6 is a front folding embodiment of the folder construction 12 with first and second side panels.

Back section 30 has top and bottom edges 30*a* and *b*, respectively. First and second side edges 30*c* and *d* meet first and second side panels 32*a* and *b* at fold lines 34*a* and *b*. Slot 36 is located near first side edge 32 in back section 30. Side panel 32*a* has top and bottom edges 38*a* and *b* and side edges 38*c* and *d*. Side edge 38*c* meets fold line 34*a* at back section 30. Opposite first side panel 32*a* is second side panel 32*b* with top and bottom edges 40*a* and *b* and first and second side edges 40*c* and *d*. Second side edge 40*c* joins back section edge 30*d* at fold line 34*b*. Slot 42 is cut in second side panel 32*b* adjacent side edge 40*c*. Artwork can be shown on back section 30 where it is disclosed for viewing through die-cut windows 44*a* and *b* in first and second side panels 32*a* and *b*. The windows may be clear acetate sheets and printed with four-color litho to produce an image.

Figure 7:
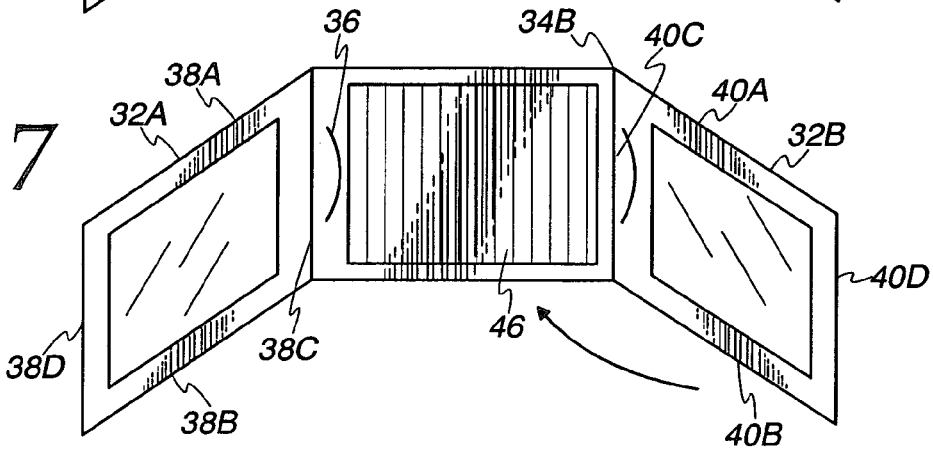
FIG. 7 is a front perspective view of an alternate embodiment of the present invention with a back section and first and second side panels wherein the back section has a lenticular image thereon.

Lenticular image 46 may also be present on the back section, as shown in FIG. 7.

Figure 8:
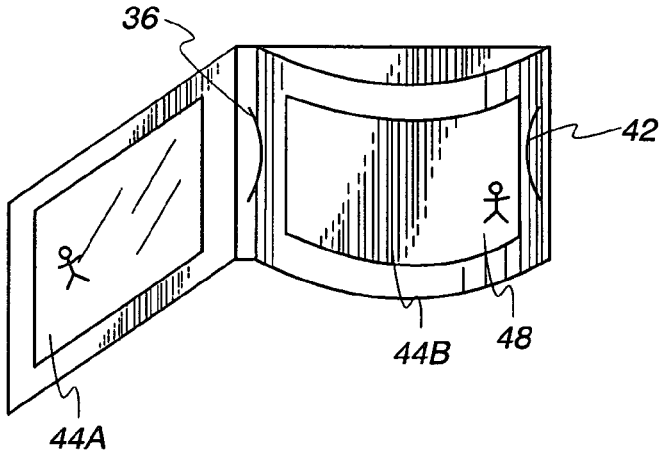
FIG. 8 is a front perspective view of an alternate embodiment of the present invention wherein a side panel is folded over the back section.
Figure 9:
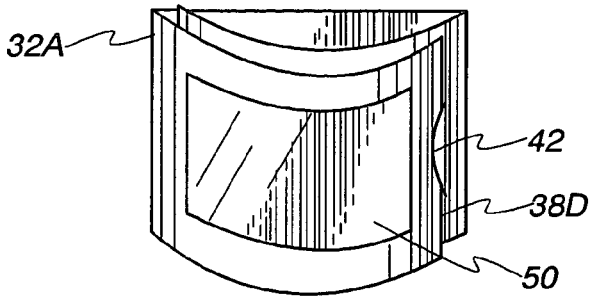
FIG. 9 is a front perspective view of an alternate embodiment of the present invention wherein the first and second side panels are folded over the back section.

To create a multi-layered, three-dimensional effect with the presentation apparatus, second side panel 32*b* may be folded at fold line 34*b*. Second side edge 40*d* engages slot 36 to create the first layer 48 for the image, as shown in FIG. 8. A second layer 50 is created by folding first side panel 32*a* at fold line 34*a*, as shown in FIG. 9. Side edge 38*d* engages slot 42 to create a second layer of images folded over back section 30. The images are not present in the drawings. The curvilinear fold of the first and second side panels creates spacing between each of the side panels and back section 30, containing an image to create a three-dimensional effect, as shown in FIGS. 8 and 9.

Another embodiment of the presentation apparatus is shown in FIG. 10, wherein back section 60 has slots 62*a* and *b* near fold lines 64*a* and *b*. Back section 60 has a front side 60*a* and rear side 60*b*, both of which provide space for artwork or images to render a three-dimensional effect. First and second side panels 66*a* and *b* have first and second edges 66*c* and *d*, respectively, as well as die-cut windows 68*a* and *b* with coverings of clear acetate sheeting upon which more than one image is placed. A clear acetate cel can be attached to a die-cut window.

The side panels can be folded at fold lines 64*a* and *b*. First side panel 66*a* is folded over the front side 60*a* of back section 60 so that first edge 66 engages slot 62*b*. This arrangement creates a three-dimensional arrangement on the front side 60*a* of back section 60. Further, second side panel 66*b* can be folded at fold line 64*b* so that it covers rear side 60*b* of back section 60 to allow second edge 66*d* to engage slot 62*a*, thereby rendering an image and three-dimensional representation on the rear side of back section 60, as seen in FIGS. 11-13.

Figure 14:
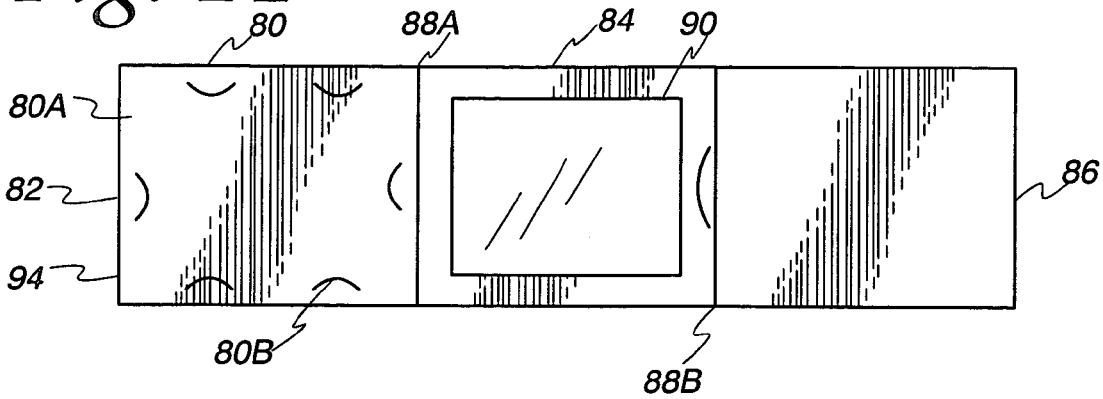
FIG. 14 is a front view of an embodiment of the present invention wherein the middle section has a die-cut window and acetate sheet placed therein for presenting an image.

Another embodiment of the presentation apparatus is shown in FIGS. 14-17. The back section is located at one end of a three-piece folder construction presentation apparatus. The back section has means for easily adding and removing artwork, photographs or drawings. In FIG. 14, back section 80 is shown on the first end 82 of the presentation apparatus, which also contains a middle section 84 and second end or front cover 86. Fold lines 88*a* and *b* are present between the ends and back section. A die-cut window 90 covered with acetate sheets or cels is present in middle section 84 for viewing an image of artwork, photograph or lenticular image on back section 80. A slot 92 is provided in middle section 84 for engaging edge 94 of middle section 84. The folding of back section 80 by its insertion into slot 92 facilitates the spacing of back section 80 and middle section 84 to provide a three-dimensional effect. Second end or front cover 86 may be folded over middle section 84 to cover the images displayed therein.

Figure 15:
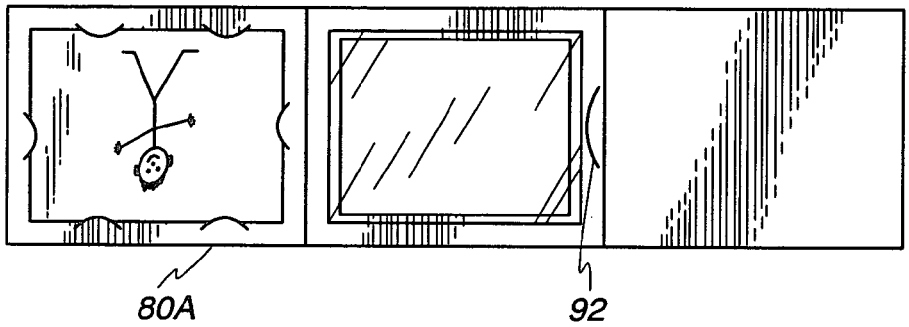
FIG. 15 is a back view of FIG. 15 with an image inserted into the back section.
Figure 16:
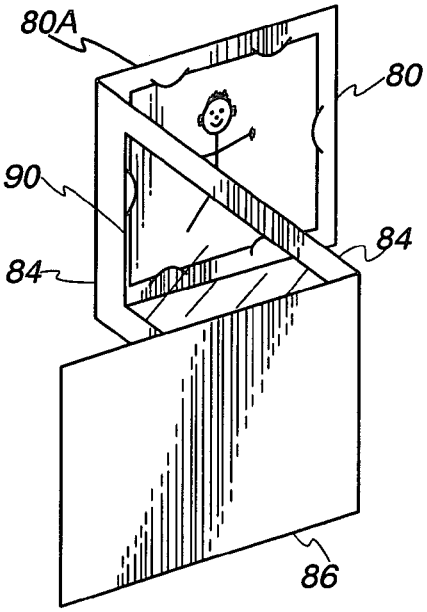
FIG. 16 is a perspective view of an embodiment of the present invention with the side panels partially folded.
Figure 17:
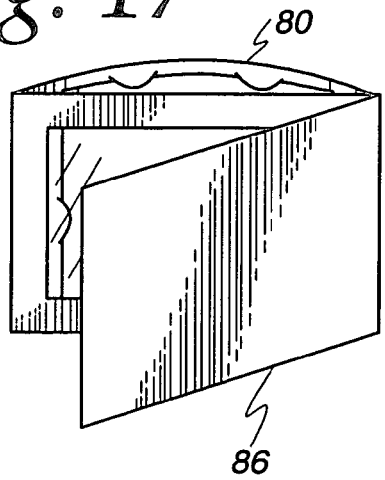
FIG. 17 is a perspective view of an embodiment of the present invention wherein a first side panel is folded and engages the back section, which includes a die-cut window and acetate sheet.
Figure 18:
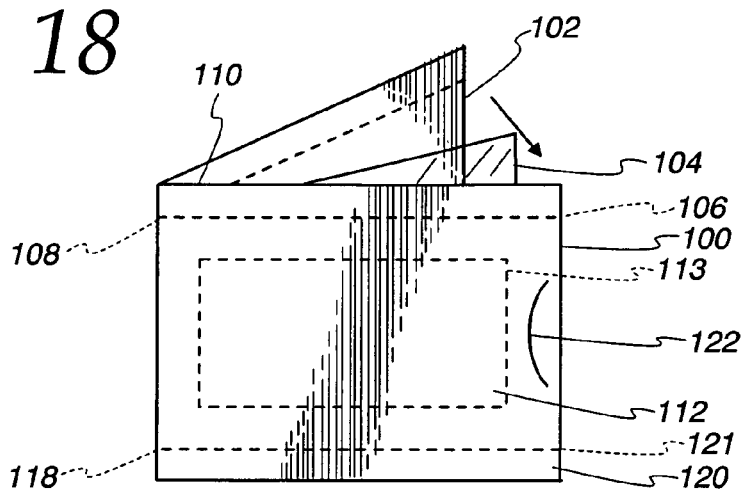
FIG. 18 is a perspective view of an embodiment of the present invention showing a side panel folded on a fold line from the back section with a plastic or acetate insert which abuts the first side panel.
Figure 19:
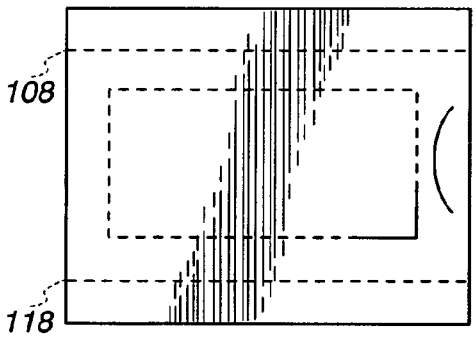
FIG. 19 is a front view of this embodiment showing dotted lines representing tear lines for removing edges when the embodiment is used as a mailer.
Figure 20:
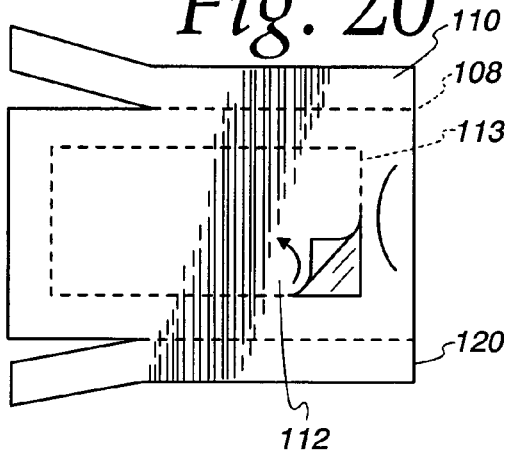
FIG. 20 is a front view of the embodiment of the present invention wherein edges are partially removed, as well as the showing of an insert.

FIG. 15 shows a rear view of this embodiment of the presentation apparatus. FIGS. 16 and 17 show the apparatus on display.

Figure 21:
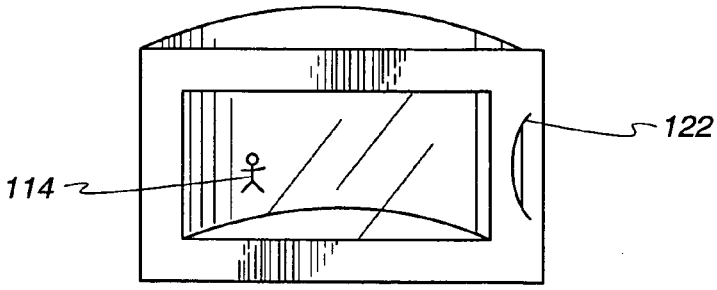
FIG. 21 is a front perspective view of an embodiment of the invention showing the folded side panel engaging the back section, the side panel having a window for viewing the back section, after the edges and insert have been removed.

FIGS. 18-21 show another embodiment of the present invention wherein side panel 100 is foldable from back section 102 with a clear plastic acetate sheet 104 placed therebetween. Top edge 106 has dotted perforations 108 for detaching top section 110 which holds the panel and back section together in a format for mailing. Insert 112 can be removed from dotted perforations 113 to disclose the clear plastic acetate sheet which may contain artwork 114 and the back section 102. Bottom edge 118 has bottom section 120 with dotted perforations 121 for removing the bottom section 120 upon receipt of the mailer. Insert 112 may contain artwork, coupons, trading cards, etc., as well as the mailing address. Slot 122 in side panel 100 is available for receiving back section 102 as shown in FIG. 21 showing a curvilinear design in back section 102.

Figure 22:
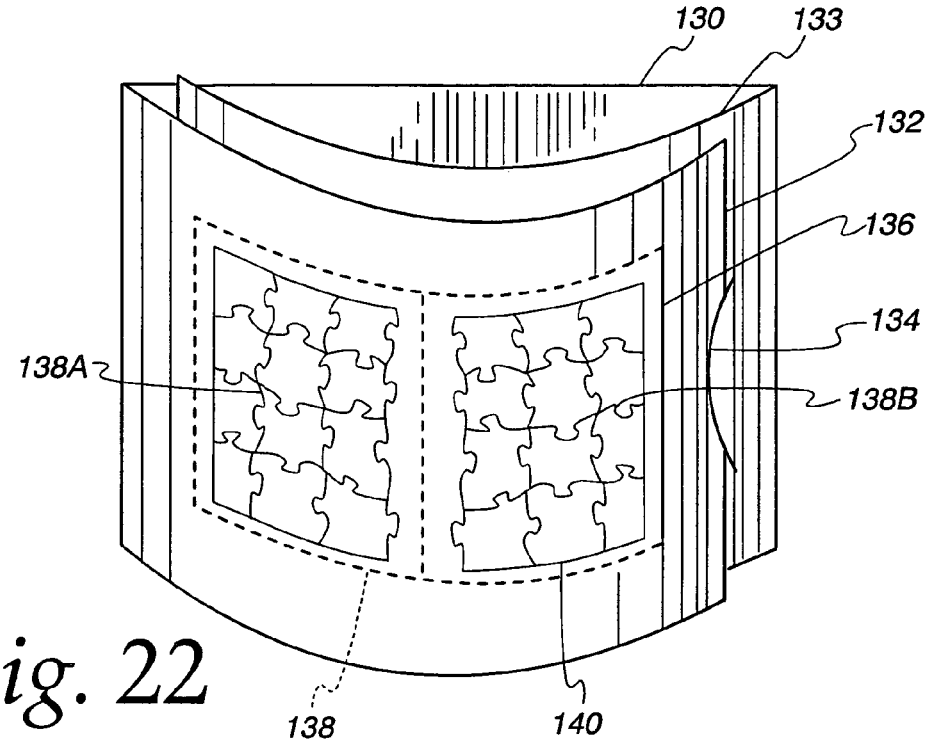
FIG. 22 is a front perspective view of an embodiment of the present invention wherein the first and second side panels are folded on opposite sides of the back section, the first side panel having multiple inserts that are configured as pieces in a puzzle.

FIG. 22 shows back panel 130 with first side panel 132 and second side panel 133. The first side panel is folded to engage slot 134 of back panel 130. The second side panel engages a slot not shown. Insert 136 of the first side panel has first section 138 and second section 140 for holding puzzle pieces 138A and 138B respectively. The pieces may be removed at perforations 141 to show the clear plastic acetate sheet 142 which may contain artwork as shown in FIGS. 21 and 23, which has only one side panel 144, with puzzle pieces removed from one section.

Figure 23:
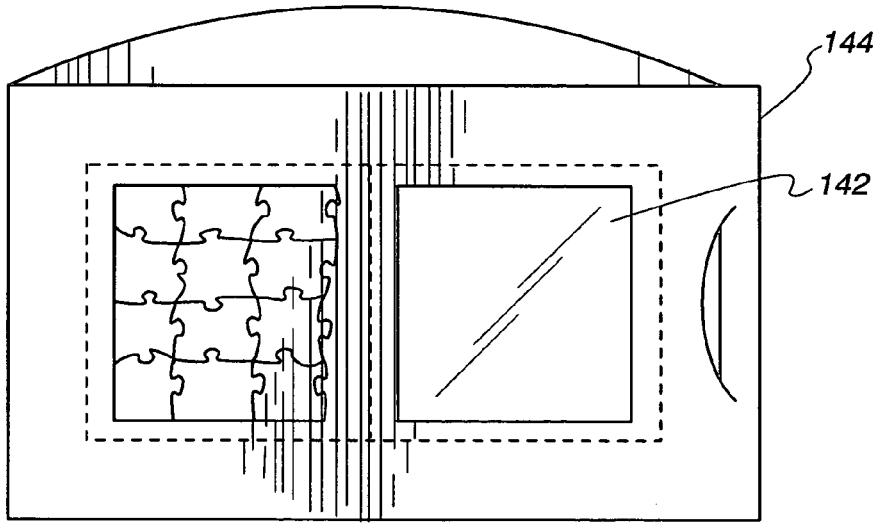
FIG. 23 is a front perspective view of an embodiment of the present invention wherein the first side panel is engaged in the back section, the first side panel having two inserts, one containing puzzle pieces, the other without puzzle pieces showing clear plastic, ready for placement of puzzle pieces.
Figure 24:
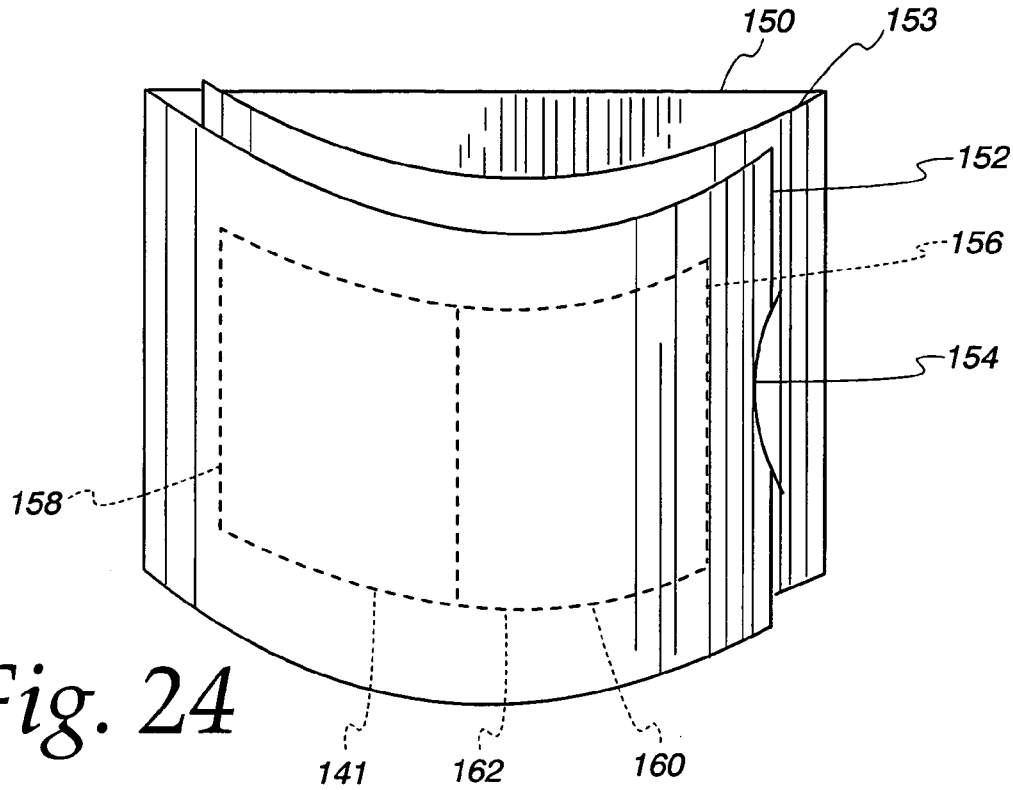
Figure 25:
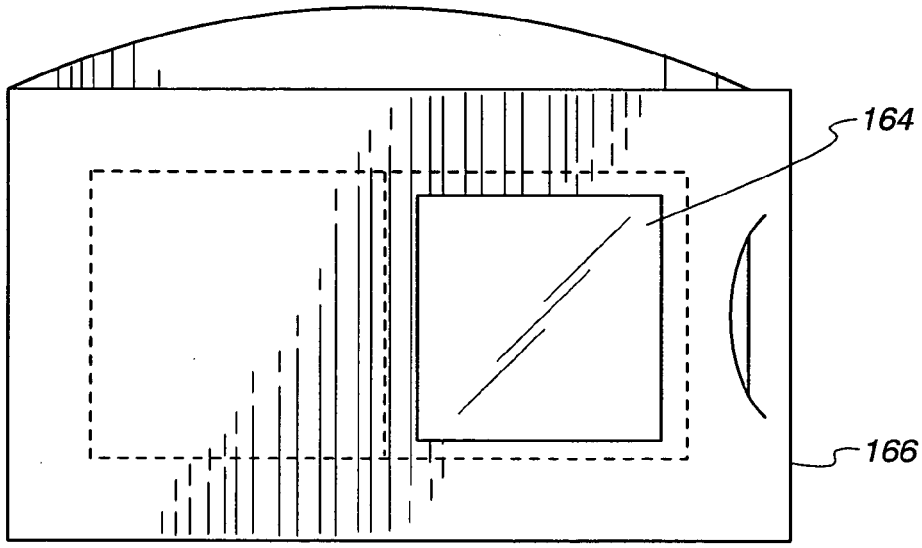
FIG. 25 is a front perspective view of an embodiment of the present invention wherein the first side panel is engaged in the back section, the first side panel having two inserts, one containing a trading card, coupon or the like, the other being removed to show a clear plastic acetate sheet.

FIG. 24 is similar to the embodiments shown in FIGS. 22 and 23, in that it shows the back panel 150 with the first side panel 152 and second side panel 153. The first side panel is folded to engage slot 154 of back panel 150. The second side panel engages a slot not shown. Insert 156, on the first side panel has first section 158 and second section 160 for holding material that may contain writing, advertisements, trading cards, coupons, etc., for use by a consumer. The pieces may be removed at perforations 162 to show clear plastic acetate sheet 164, which may contain artwork as shown in FIGS. 21 and 25, which have only one side panel 166 with one piece removed from one section.

All the embodiments of the present invention are free-standing when the side panel(s) are engaged. The free-standing arrangement of the device facilitates display of the device on a surface. It may also be hung from a wall.

It will be evident that a number of variations can be made while remaining within the scope of the following claims.

What is claimed is:

1. A mailer containing artwork comprising: a one-piece folder construction having a first side panel and a back having a lenticular image, the first side panel being foldable over the back section, and engages the back section and the first side panel having a viewing section comprising a die-cut window containing a plastic sheet for viewing the back section when the first side panel is folded over the back section to provide for three-dimensional artwork when displayed, wherein the back section is folded in curvilinear design, where said first side panel and back section have top and bottom edges respectfully, said edges having perforations for removably detaching the edges and a removably detachable insert which covers the die-cut window.

2. A mailer containing artwork comprising: a one-piece folder construction having a first side panel and a back section, the first side panel being foldable over the back section, and engages the back section and the window containing first side panel having a viewing section comprising a die-cut acetate or plastic sheet for viewing the back section, wherein the acetate or plastic sheet in the die cut window of the first side panel contains artwork and is folded over the back section to provide for three-dimensional artwork when displayed, wherein the back section is folded in curvilinear design, where said first side panel and back section have top and bottom edges respectively, said edges having perforations for removably detaching the edges and a removably detachable insert that covers the die-cut window.

* * * * *